US010147342B2

(12) United States Patent
Gogatz et al.

(10) Patent No.: US 10,147,342 B2
(45) Date of Patent: Dec. 4, 2018

(54) MAGNETIC VEHICLE FLAG FOR EMERGENCY ROADSIDE ASSISTANCE

(71) Applicants: Robert Gogatz, Marshville, NC (US); Anthony Gogatz, Marshville, NC (US)

(72) Inventors: Robert Gogatz, Marshville, NC (US); Anthony Gogatz, Marshville, NC (US)

( * ) Notice: Subject to any disclaimer, the term of this patent is extended or adjusted under 35 U.S.C. 154(b) by 203 days.

(21) Appl. No.: 15/248,466

(22) Filed: Aug. 26, 2016

(65) Prior Publication Data

US 2018/0061286 A1 Mar. 1, 2018

(51) Int. Cl.
*G09F 17/00* (2006.01)

(52) U.S. Cl.
CPC ..... *G09F 17/00* (2013.01); *G09F 2017/0075* (2013.01)

(58) Field of Classification Search
CPC ..... G09F 17/00; G09F 2017/0075
USPC ..... 116/28 R, 30, 42, 63 T, 173–174, 209
See application file for complete search history.

(56) References Cited

U.S. PATENT DOCUMENTS 2,856,891 A * 10/1958 Solomon ..... E04H 12/32 116/173
3,148,856 A * 9/1964 Orlando ..... G09F 1/14 116/173
3,158,132 A * 11/1964 Guthrie ..... G09F 17/00 116/173
3,241,516 A * 3/1966 Hopkins ..... H01F 7/0252 116/173
3,245,165 A * 4/1966 Podoloff ..... F16B 5/0258 248/467
3,361,404 A * 1/1968 Lohr ..... B60J 3/0217 248/206.5
3,910,540 A * 10/1975 Kayler ..... B60Q 1/2611 248/500
3,955,786 A * 5/1976 Duddy ..... B60R 13/00 248/537
4,002,138 A * 1/1977 Dobala ..... B60Q 7/005 116/173
4,091,553 A * 5/1978 Glennie ..... B60Q 7/005 116/173
4,144,833 A * 3/1979 Newman, Sr. ..... B60Q 7/005 116/173
4,422,137 A * 12/1983 Watts ..... F21V 15/04 248/206.5
4,574,726 A * 3/1986 Sullivan ..... B60R 13/005 116/174
4,700,655 A * 10/1987 Kirby ..... B60R 13/00 116/174
4,750,450 A * 6/1988 Wiegand ..... G09F 17/00 116/173
5,031,347 A * 7/1991 Berg ..... B60Q 1/268 40/539
5,042,418 A * 8/1991 Hoover ..... B60R 13/005 116/173
5,156,274 A * 10/1992 Williams, Jr. ..... G09F 21/04 206/573

(Continued)

*Primary Examiner* — R. A. Smith
*Assistant Examiner* — Tania Courson
(74) *Attorney, Agent, or Firm* — Jeffrey C. Watson; Mathew L. Grell; Grell & Watson Patent Attorneys LLC

(57) ABSTRACT

A magnetic emergency roadside assistance flag for a car includes a pole, a flag, and an attachment. The flag is positioned on the pole. The attachment is at a proximal end of the pole. The attachment is configured to connect to the outside of a vehicle.

6 Claims, 9 Drawing Sheets

(56) References Cited

U.S. PATENT DOCUMENTS

| | | | | |
|---|---|---|---|---|
| 5,277,214 | A * | 1/1994 | Tolley | E04H 15/06 135/115 |
| 6,112,443 | A * | 9/2000 | Stubbs | G09F 21/04 116/173 |
| 7,703,228 | B2 * | 4/2010 | Zheng | E04H 15/40 116/63 T |
| 7,992,333 | B1 * | 8/2011 | McGuinness | G09F 3/16 116/28 R |
| 9,368,050 | B2 * | 6/2016 | Bigham | G09F 17/00 |
| 2002/0043205 | A1 * | 4/2002 | Frost | B60Q 1/2611 116/28 R |
| 2002/0047810 | A1 * | 4/2002 | Chatzipetros | H01Q 1/3275 343/713 |
| 2005/0018444 | A1 * | 1/2005 | Todd | B60Q 1/2615 362/545 |
| 2005/0178033 | A1 * | 8/2005 | Elmer | G09F 7/04 40/600 |
| 2007/0283877 | A1 * | 12/2007 | Durkin | G09F 17/00 116/209 |
| 2009/0199762 | A1 * | 8/2009 | Elam | B60Q 7/00 116/28 R |
| 2015/0000587 | A1 * | 1/2015 | Chaney | G09F 17/00 116/173 |
| 2015/0033604 | A1 * | 2/2015 | Bigham | G09F 17/00 40/591 |
| 2015/0213741 | A1 * | 7/2015 | Bigham | G09F 17/00 116/173 |
| 2016/0090029 | A1 * | 3/2016 | Levytsky | B60J 11/04 340/473 |
| 2016/0379532 | A1 * | 12/2016 | Tomlinson | G09F 17/00 116/173 |
| 2018/0090038 | A1 * | 3/2018 | Kesler | G09F 17/00 |

* cited by examiner

MAGNETIC VEHICLE FLAG FOR EMERGENCY ROADSIDE ASSISTANCE

CROSS-REFERENCE TO RELATED APPLICATIONS

None

FEDERALLY SPONSORED RESEARCH OR DEVELOPMENT

None

PARTIES TO A JOINT RESEARCH AGREEMENT

None

REFERENCE TO A SEQUENCE LISTING

None

BACKGROUND OF THE DISCLOSURE

Technical Field of the Disclosure

The instant disclosure generally relates to automobile accessories and emergency roadside assistance accessories for cars or vehicles. More particularly, the instant disclosure relates to a magnetic vehicle flag for emergency roadside assistance. However, the disclosure may be utilized for other things beside emergency roadside assistance, like for affinity or allegiance to a country, team, business, etc., or any other uses for a magnetic flag pole.

Description of the Related Art

Emergency roadside assistance is needed when a car breaks down. The standard procedure is to pull the car over to the side of the road (if possible) and make the car as visible as possible, like by putting on hazard lights, interior lights, etc. Another safety tip that is commonly carried out is to signal passing vehicle or emergency service personnel (police, ambulance, fire, etc.) for distress or of a stranded vehicle by hanging a white towel or cloth, or other visible material that is available, outside of the car by rolling the window down and closing the window on the towel or cloth. However, this requires one to keep a white towel or cloth in the vehicle, or to have one available. In addition, one of the main issues that stranded vehicles encounter is dead batteries, where it is not possible to turn on any of the lights or even roll down the window to put a white cloth or towel out for a signal, as most cars today come standard with power windows, which will not operate when the battery is drained or dead.

As a result, vehicles stranded on the side of the road are often involved in accidents, especially at night, as they are not visible by oncoming traffic. Thus, there is clearly a need to provide a very visible means for signaling stranded vehicle on the side of the road that is convenient and functional even when the battery is dead or drained.

Flags for vehicles are known and are often representative of an individual's affinity or allegiance to a country, team or business and can be presented in various ways. These flags for vehicles are typically made of standard cloths that are only visible during the day. A popular trend that has surfaced revolves around the idea of the 'mobile' flag in which an individual displays their particular flag of choice on their vehicle. These items are commonly referred to as car flags and are usually manufactured from high strength polyester material and are attached to the window of a vehicle via a polypropylene pole and clip window attachment. This clip window attachment is attached to the window by rolling the window down, inserting the clip window attachment over top of the window, and rolling the window back up to secure the clip window attachment between the top of the window and the vehicle.

As a result, known vehicle flags are not usable signals for emergency roadside assistance as they are not reflective and/or require the battery to be functional to roll down the window to attach the clip window attachment.

Thus, there is clearly a need for an emergency roadside assistance flag for a car or vehicle that is highly visible and can be easily attached to the car even when the battery is drained or dead.

The instant disclosure of a magnetic vehicle flag for emergency roadside assistance is designed to address at least some aspects of the problems discussed above.

SUMMARY

Briefly described, in a possibly preferred embodiment, the present disclosure overcomes the above-mentioned disadvantages and meets the recognized need for such a device by providing a magnetic vehicle flag for emergency roadside assistance. Although the disclosure may be ideal for a vehicle flag that may be used for emergency roadside assistance, as discussed in detail herein, the disclosure is not so limited and the flag system may be used or connected to other devices besides vehicles, and may be used for other purposes besides signaling/cautioning for emergency roadside assistance.

In one aspect, the instant disclosure embraces a vehicle flag with a pole, a flag, and an attachment. The flag may be positioned on the pole. The attachment may be at a proximal end of the pole. The attachment may be configured to connect to an outside of a vehicle.

One feature of the instant vehicle flag may be the inclusion of a magnet for connecting to sheet metal on the outside of the vehicle. The magnet may have a pull strength configured to secure the vehicle flag to the sheet metal on the outside of the vehicle in the environment. In select embodiments, the magnet may be a donut shaped magnet made of a grade 5 ceramic. In these embodiments, the donut shape may include an inside diameter, an outside diameter, and a thickness. The inside diameter may be sized to fit around the attachment at the proximal end of the pole. The outside diameter may be sized to fit within the attachment at the proximal end of the pole. The thickness may be sized to fit within the attachment at the proximal end of the pole.

Another feature may be the inclusion of at least two flanges at the proximal end of the pole. The flanges may be configured to position and center the donut shaped magnet around the pole. The flanges may be sized with a combined width approximately equal to the inside diameter of the donut shaped magnet. Whereby, the flanges may restrict radial movement of the magnet about the pole. In select embodiments, the pole may include four flanges equally spaced around the proximal end of the pole.

Another feature of the attachment at the proximal end of the pole may be the inclusion of a bottom surface. The bottom surface may be at the proximal end of the pole and may be sized to shield a bottom of the magnet. As such, when the vehicle flag is mounted on the sheet metal of the outside of the vehicle, the bottom surface may be positioned between the sheet metal and the bottom of the magnet.

Another feature of the attachment at the proximal end of the pole may be the inclusion of a cover for the magnet. The cover may be sized to fit over a top of the magnet and around an outside of the magnet. As such, the cover and the bottom surface may combine to conceal the magnet on the proximal end of the pole. In select embodiments, the cover may include a raised portion sized to fit over the top of the plurality of flanges at the proximal end of the pole. In other select embodiments, the pole may include a lip configured to lock the cover in place on the magnet. The lip may be compressible in the downward direction for sliding the cover down the pole and over the lip.

Another feature of the instant vehicle flag may be a lock near a distal end of the pole. The lock may be configured to lock the flag on the pole. In select embodiments, the lock may include a clip and an indention. The indention may be near the distal end of the pole and may be configured to receive the clip. Whereby, once the flag is positioned on the pole, and the clip is inserted into the indention, the clip may lock the flag on the pole.

Another feature of the instant vehicle flag for emergency roadside assistance may be that the flag can include a reflective material. In select embodiments, the flag may be on both sides and may be configured to make the flag visible at night to oncoming traffic in both directions.

Another feature of the instant vehicle flag for emergency roadside assistance may be that the flag can include a caution symbol on one or both sides. In select embodiments, the caution symbol may be on both sides. In other select embodiments, the caution symbol may be a triangle that may be made from the reflective material. The triangle may have a thickness configured to make the triangle visible at night to oncoming traffic in both directions.

Another feature of the instant vehicle flag for emergency roadside assistance may be that the flag can include a base neon color made of a vinyl scrim and the triangle may be a bright white made of reflective calendared vinyl.

Another feature of the instant vehicle flag for emergency roadside assistance may be that the flag can include a width and a length sized to be visible by oncoming traffic.

Another feature of the instant vehicle flag for emergency roadside assistance may be that the flag can include a pocket along a top edge configured to receive the pole. In select embodiments, the pocket may have a diameter of approximately 0.5 inches and the pole may have a corresponding diameter of approximately 0.5 inches.

Another feature of the instant vehicle flag for emergency roadside assistance may be that the flag can include a flame retardant material for making the flag flame resistant.

In another aspect, the instant disclosure embraces a magnetic flag pole. The magnetic flag pole may generally include a pole and an attachment at a proximal end of the pole. The attachment may include a magnet for connecting the pole to magnetic surfaces. As an example, the magnet in the attachment may be configured to connect to sheet metal on the outside of a vehicle. As such, in select embodiments, the magnet may have a pull strength configured to secure the magnetic flag pole to the sheet metal on the outside of the vehicle in the environment. In select embodiments, the magnet may be a donut shaped magnet made of a grade 5 ceramic, wherein the donut shape may include an inside diameter, an outside diameter, and a thickness. The inside diameter may be sized to fit around the attachment at the proximal end of the pole. The outside diameter may be sized to fit within the attachment at the proximal end of the pole. The thickness may be sized to fit within the attachment at the proximal end of the pole.

One feature of the magnetic flag pole may be the inclusion of at least two flanges at the proximal end of the pole. The flanges may be configured to position and center the donut shaped magnet around the pole. The flanges may be sized with a combined width approximately equal to the inside diameter of the donut shaped magnet, whereby, the at least two flanges may restrict radial movement of the magnet about the pole.

Another feature of the magnetic flag pole may be that the attachment at the proximal end of the pole may include a bottom surface at the proximal end of the pole. The bottom surface may be sized to shield a bottom of the magnet. As such, when the magnetic flag pole may be mounted on the sheet metal of the outside of the vehicle, the bottom surface may be positioned between the sheet metal and the bottom of the magnet.

Another feature of the magnetic flag pole may be that the attachment at the proximal end of the pole may include a cover sized to fit over a top of the magnet and around an outside of the magnet. In select embodiments, the cover may include a raised portion sized to fit over the top of the flanges at the proximal end of the pole. In other select embodiments, the pole may include a lip configured to lock the cover in place on the magnet. The cover and the bottom surface may combine to conceal the magnet on the proximal end of the pole.

Another feature of the magnetic flag pole may be that the inclusion of a lock near a distal end of the pole. The lock may be configured to lock a flag on the pole. In select embodiments, the lock may include a clip and an indention near the distal end of the pole configured to receive the clip. Whereby, once the flag is positioned on the pole, and the clip is inserted into the indention, the clip locks the flag on the pole.

In use, the instant disclosure also embraces a method of signaling for emergency roadside assistance utilizing the vehicle flag or magnetic flag pole in any of the embodiments shown and or described herein. In general, the method of signaling for emergency roadside assistance may include the steps of:

providing the vehicle flag (or magnetic flag pole) in any of the various embodiments shown and/or described herein; and attaching the vehicle flag on the outside of the vehicle.

In select embodiments of the method of signaling for emergency roadside assistance, when the attachment includes a magnet for connecting to sheet metal on the outside of the vehicle, the step of attaching the vehicle flag on the outside of the vehicle may include attaching the vehicle flag on the sheet metal on the outside of the vehicle, like at a convenient location on the sheet metal just above the driver's window, where the driver does not have to get out of the vehicle to attach or mount the flag to the car.

BRIEF DESCRIPTION OF THE DRAWINGS

The present apparatuses, systems and methods will be better understood by reading the Detailed Description with reference to the accompanying drawings, which are not necessarily drawn to scale, and in which like reference numerals denote similar structure and refer to like elements throughout, and in which.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

In describing the exemplary embodiments of the present disclosure, as illustrated in FIGS. 1-6, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples.

Figure 1:
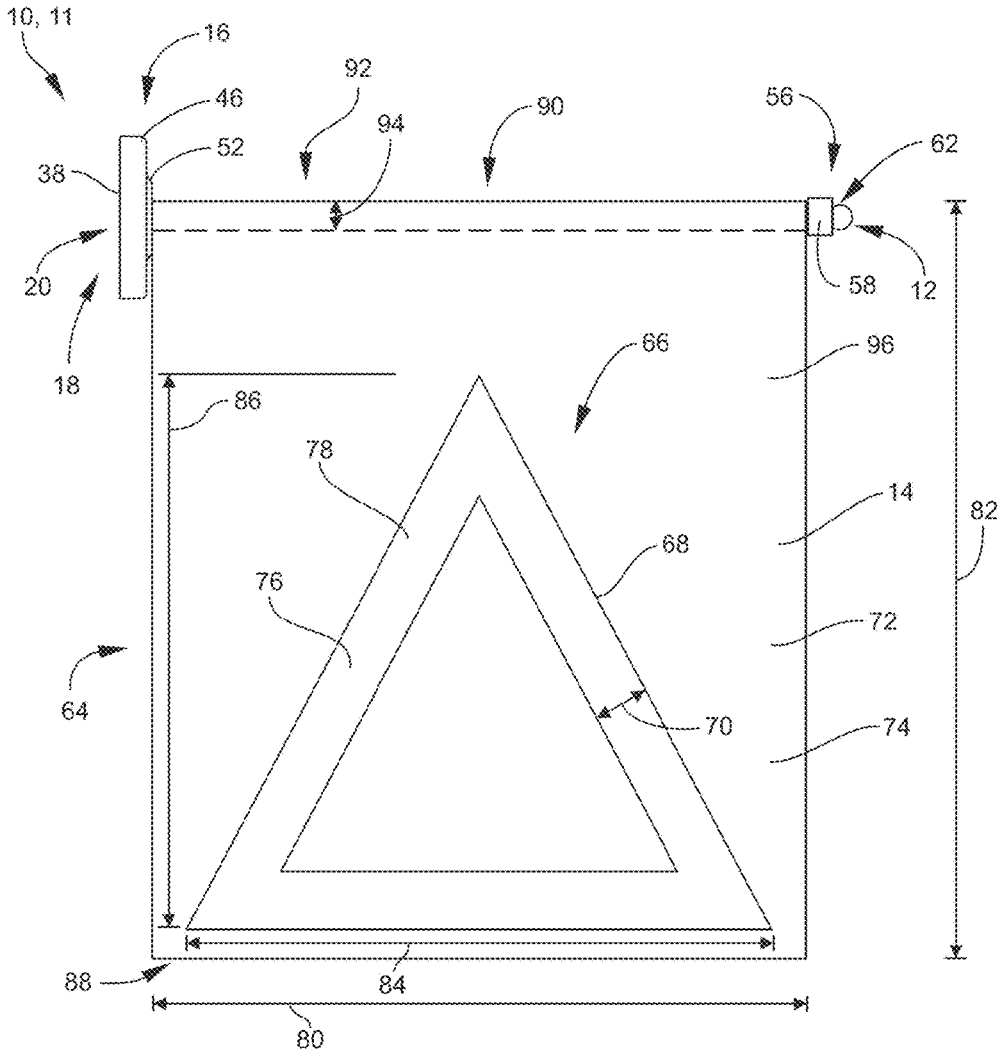
FIG. 1 is a schematic front view of the magnetic vehicle flag for emergency roadside assistance according to select embodiments of the instant disclosure.
Figure 2:
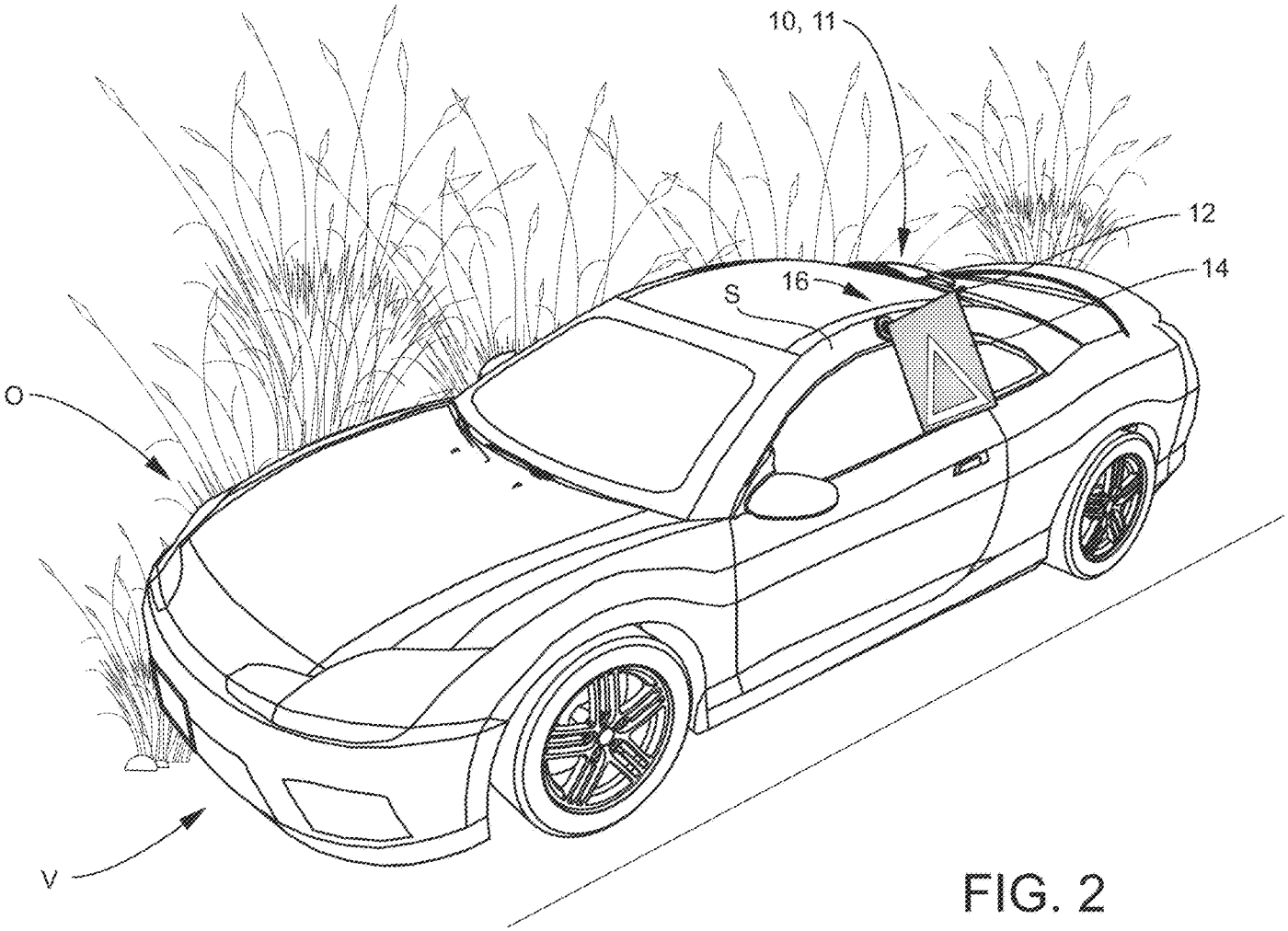
FIG. 2 is a schematic environmental perspective view of the magnetic vehicle flag for emergency roadside assistance from FIG. 1 mounted on the sheet metal on the outside of the vehicle.
Figure 3:
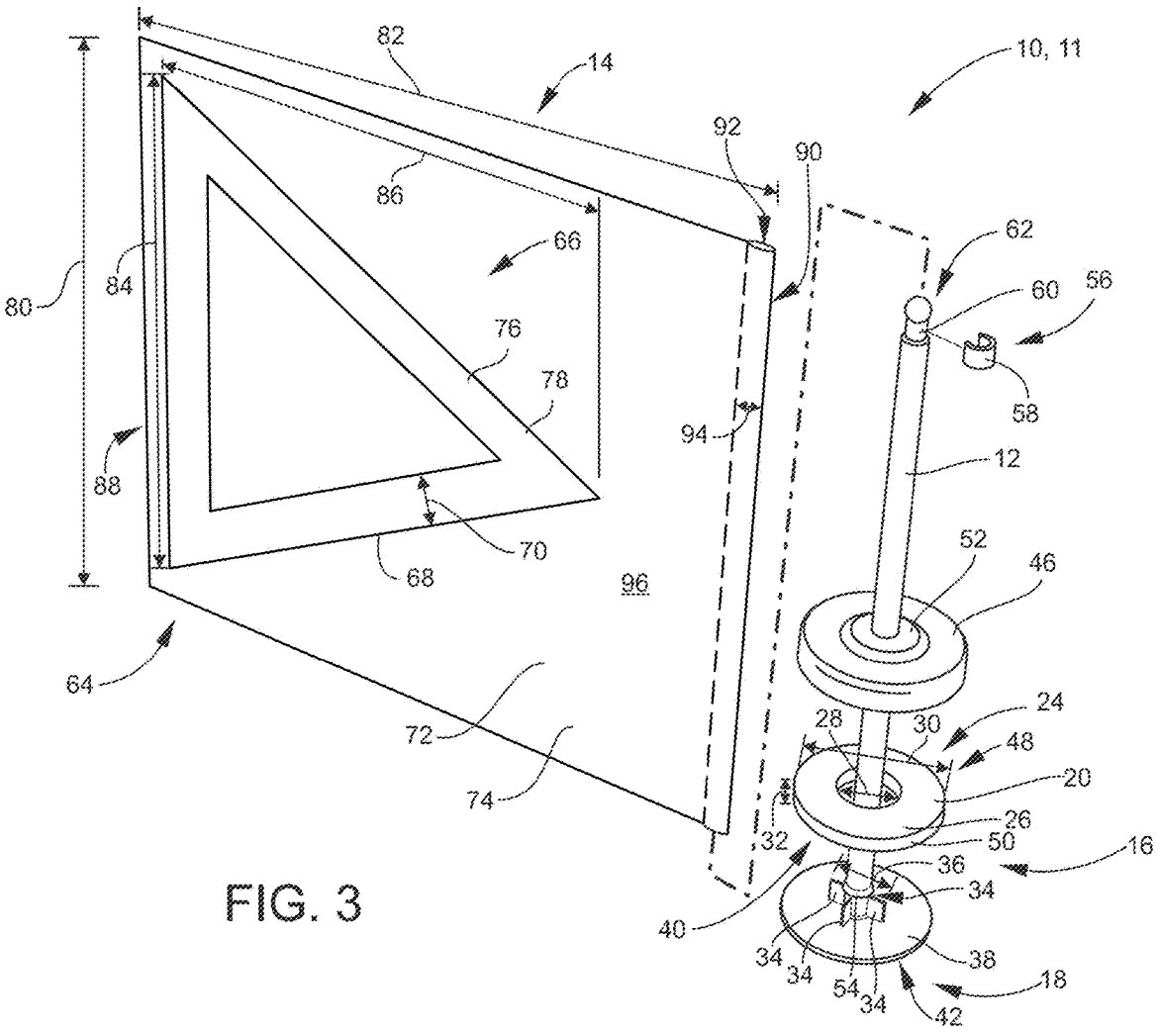
FIG. 3 is a schematic exploded perspective view of the magnetic vehicle flag for emergency roadside assistance from FIG. 1 with the parts disassembled.
Figure 4:
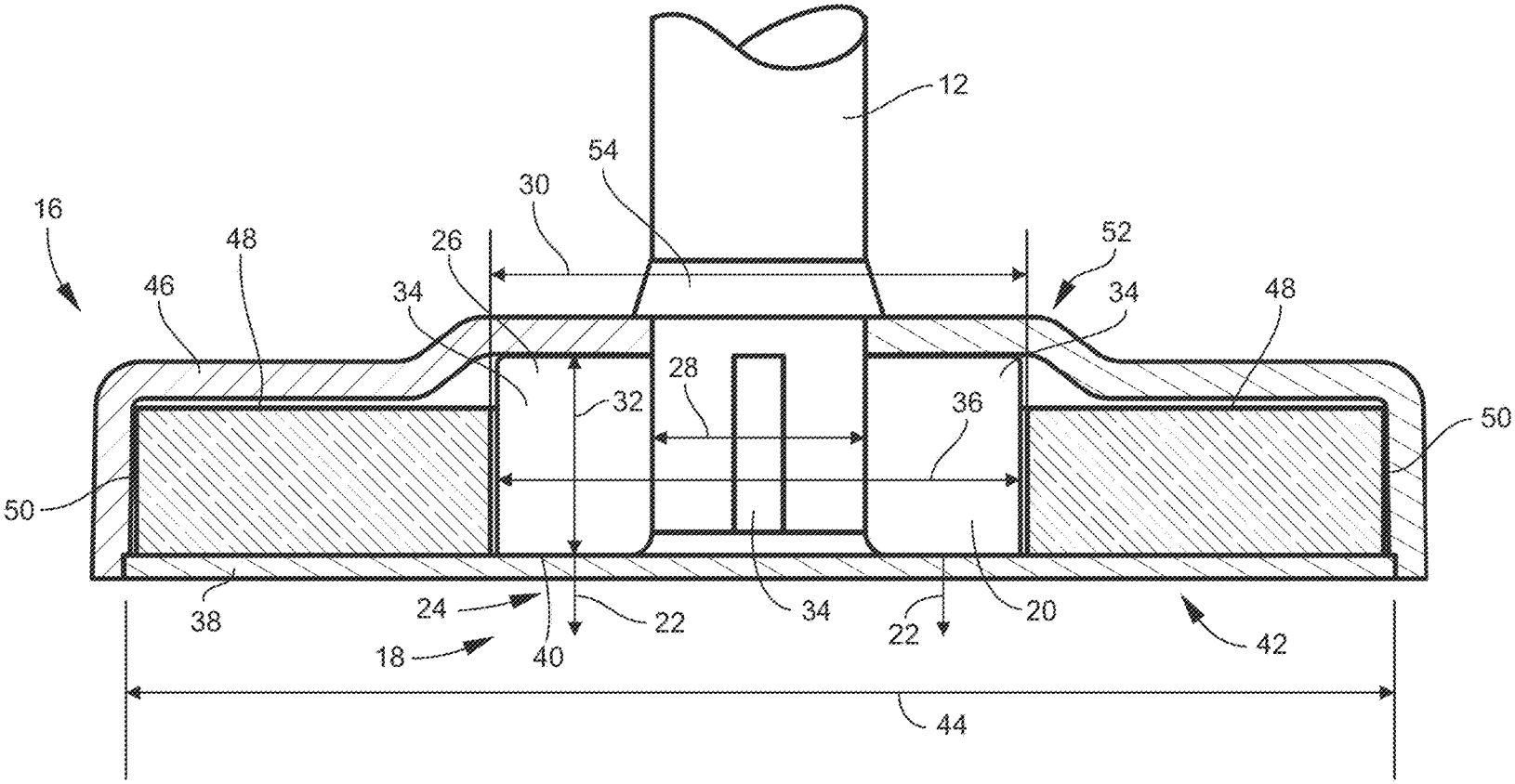
FIG. 4 is a schematic zoomed in view of the attachment for the magnetic vehicle flag for emergency roadside assistance according to select embodiments partially broken away to reveal the inside of the attachment.
Figure 5A:
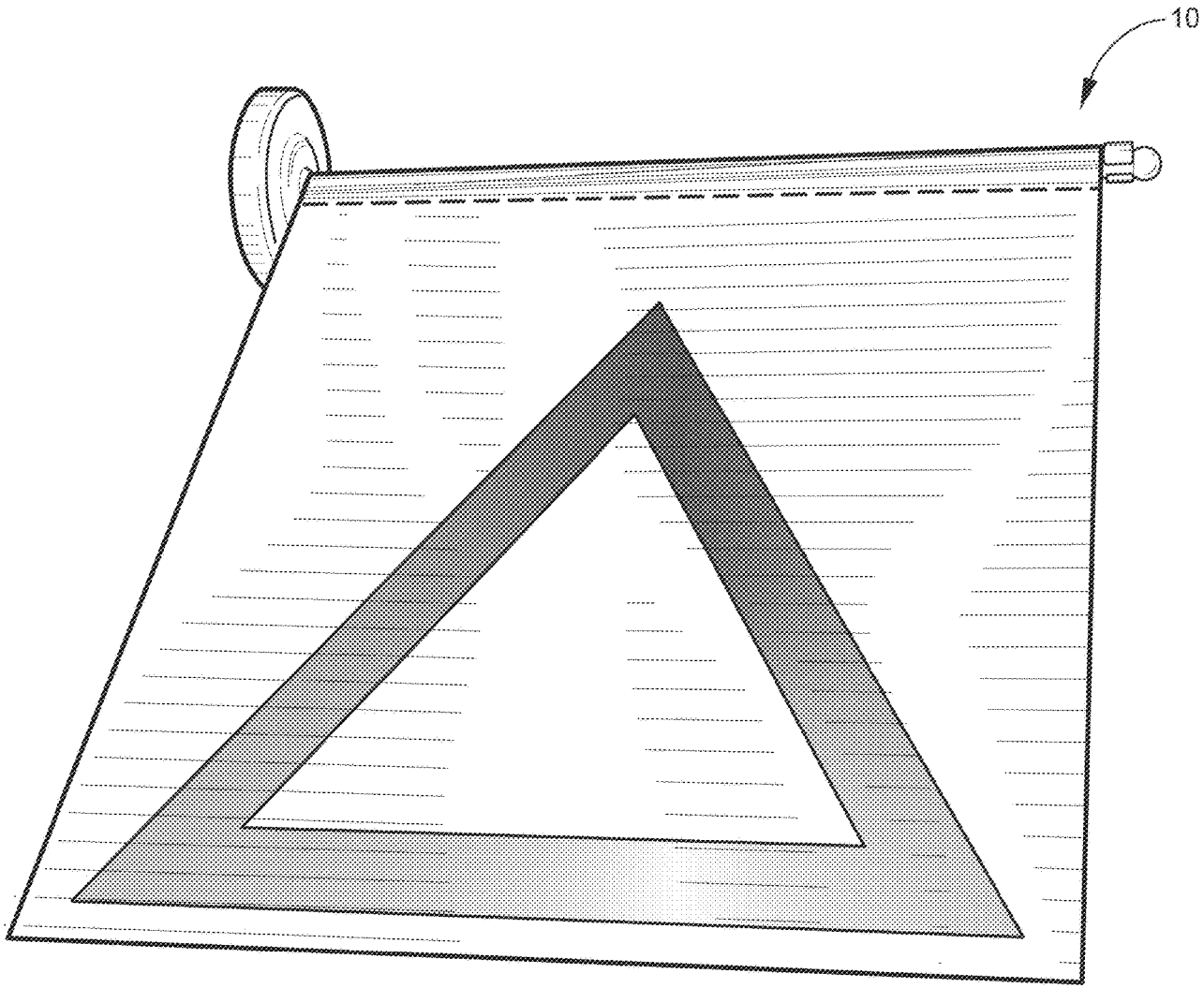
FIG. 5A is a front perspective view of one design of the magnetic vehicle flag for emergency roadside assistance according to select embodiments.
Figure 5B:
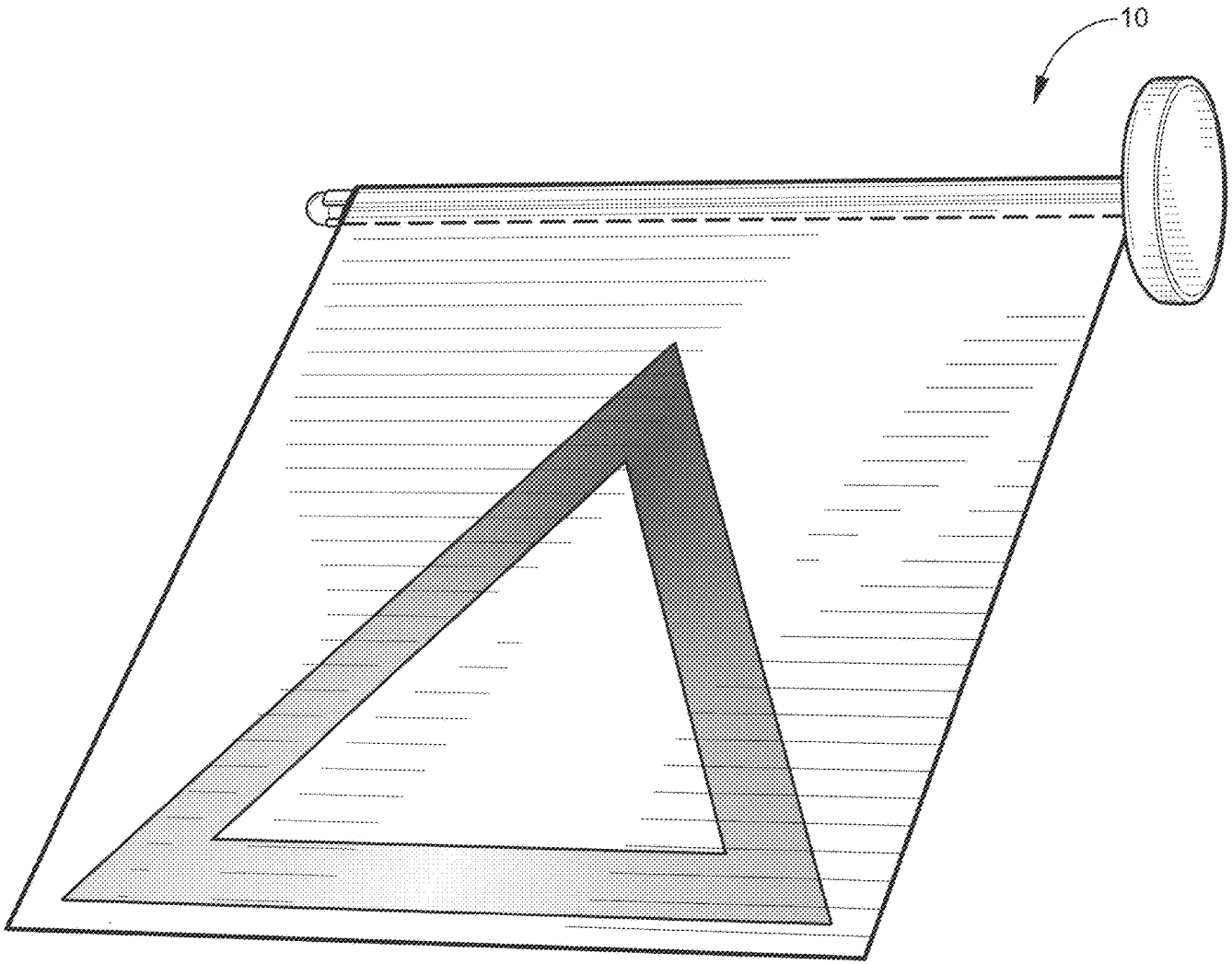
FIG. 5B is a back perspective view of the magnetic vehicle flag for emergency roadside assistance from FIG. 5A.
Figure 5E:
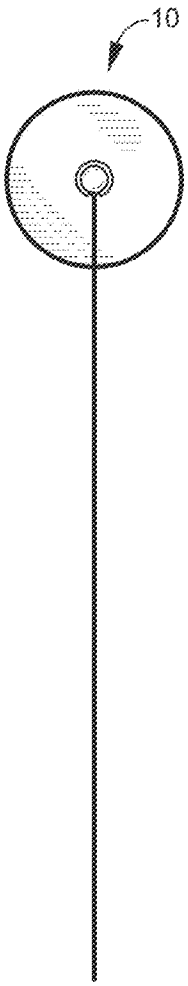
FIG. 5E is a right side view of the magnetic vehicle flag for emergency roadside assistance from FIG. 5A.
Figure 5D:
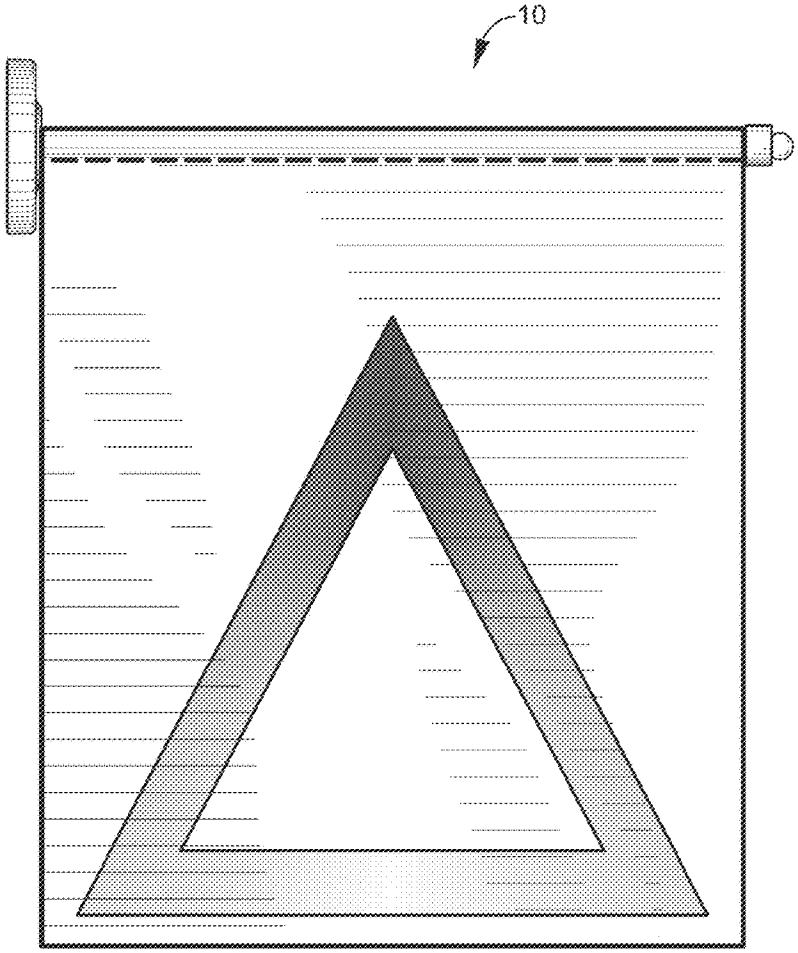
FIG. 5D is a front view of the magnetic vehicle flag for emergency roadside assistance from FIG. 5A.
Figure 5C:
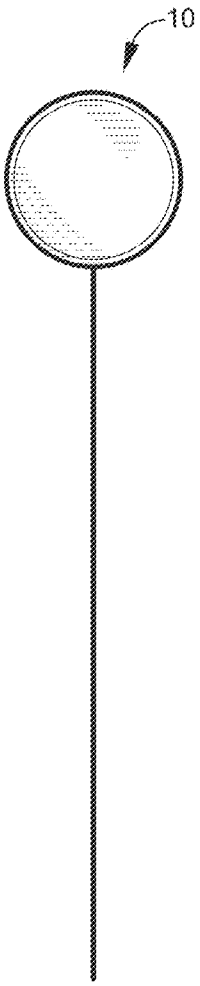
FIG. 5C is a left side view of the magnetic vehicle flag for emergency roadside assistance from FIG. 5A.
Figures 5F, 5G, 5H:
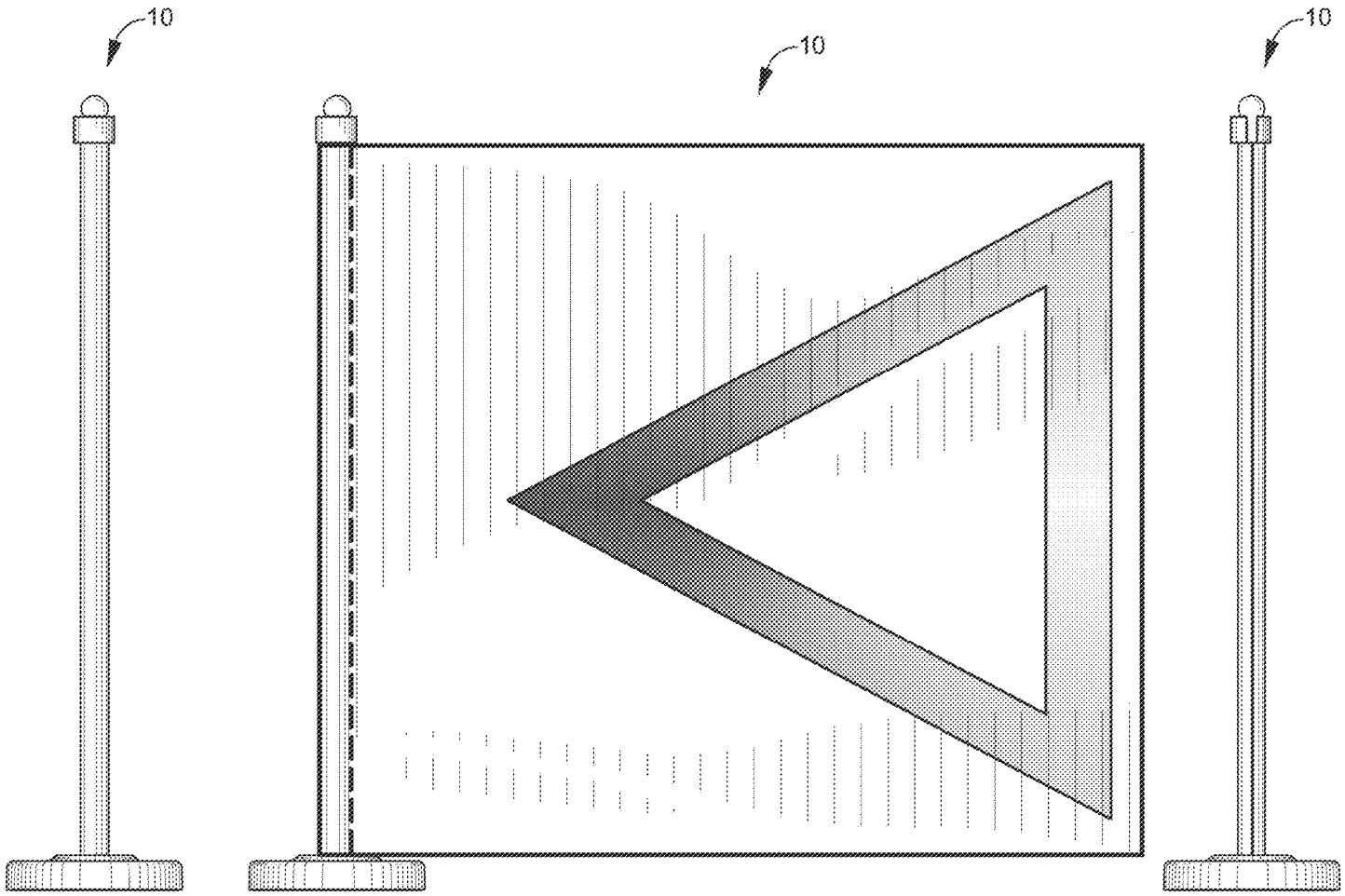
FIG. 5F is a top view of the magnetic vehicle flag for emergency roadside assistance from FIG. 5A.
FIG. 5G is a back view of the magnetic vehicle flag for emergency roadside assistance from FIG. 5A.
FIG. 5H is a bottom view of the magnetic vehicle flag for emergency roadside assistance from FIG. 5A.

Referring now to FIGS. 1-5 by way of example, and not limitation, therein is illustrated example embodiments of vehicle flag 10. Vehicle flag 10 may be for attachment to the outside O of a vehicle V, like on the sheet metal S, as shown in FIG. 2. For example, vehicle flag 10 may be attached to the sheet metal S at a convenient location that does not require the user to exit the vehicle, like above the driver's window. As such, vehicle flag 10 may be used in emergency situations for roadside assistance or to signal oncoming traffic of the stranded vehicle on the side of the road. However, vehicle flag 10 is not limited to placement on vehicle V or for signaling oncoming traffic, as vehicle flag 10 may be attached on any desired device and may include any signal, notification, country, team, location, business, the like, etc., as may be desired.

As shown in FIGS. 1-5, vehicle flag 10 may generally include pole 12, flag 14, and attachment 16. Pole 12 may be for holding flag 14. As such, flag 14 may be positioned on pole 12. Attachment 16 may be at proximal end 18 of pole 12. Attachment 16 may be configured to connect to outside O of vehicle V, as shown in FIG. 2. In select embodiments, as shown in the figures, attachment 16 may include magnet 20 for connecting to sheet metal S on outside O of vehicle V. As an example, and clearly not limited thereto, pole 12 and attachment 16 may include molded parts made from plastics or other like materials.

Magnet 20 may be any desired shape, size or power of a magnet for connecting vehicle flag 10 to the desired surface, like sheet metal S on vehicle V. In select embodiments, magnet 20 may have pull strength 22 configured to secure vehicle flag 10 to sheet metal S on outside O of vehicle V in the environment. See FIG. 4. As such, vehicle flag 10 may stay connected to vehicle V during any adverse weather, like wind, rain, snow, etc. In addition, magnet 20 may be designed to keep vehicle flag 10 positioned on sheet metal S of vehicle V during driving. In select embodiments, pull strength 22 of magnet 20 may be greater than 40 lbs. In other select embodiments, pull strength 22 of magnet 20 may be greater than 60 pounds. In other possibly preferred embodiments, pull strength 22 of magnet 20 may be approximately or equal to 72 pounds. As an example, magnet 20 may be grade 5 ceramic magnet 26 with pull strength 22 of 72 pounds.

As mentioned earlier, magnet 20 may be any desired size or shape for attachment 16 on vehicle flag 10. In select embodiments, as shown in the figures, magnet 20 may be donut shaped magnet 24. Donut shape 24 may include inside diameter 28, outside diameter 30, and thickness 32. Inside diameter 28 may be sized to fit around attachment 16 at proximal end 18 of pole 12. Outside diameter 30 may be sized to fit within attachment 16 at proximal end 18 of pole 12. Thickness 32 may be sized to fit within attachment 16 at proximal end 18 of pole 12. As examples, and clearly not limited thereto, inside diameter 28 may be approximately or equal to 1.203 inches, outside diameter 30 may be approximately or equal to 2.8 inches, and/or thickness 32 may be approximately or equal to 0.33 inches.

At least two flanges 34 may be included in attachment 16. Flanges 34 may be at the proximal end 18 of pole 12. Flanges 34 may be configured to position and center magnet 20 around pole 12. Flanges 34 may be sized with combined width 36 of approximately equal to inside diameter 28 of the donut shaped magnet 24. As such, flanges 34 may hold magnet 20 in place at the proximal end 18 of pole 12 by restricting radial movement of magnet 20 about pole 12. Attachment 16 of pole 12 may include any number of flanges 34 on proximal end 18. In select embodiments, as shown in the figures, pole 12 may include four flanges 34 equally spaced around proximal end 18 of pole 12.

Bottom surface 38 may be included on pole 12 or in attachment 16. Bottom surface 38 may be positioned at proximal end 18 of pole 12. Bottom surface 38 may be sized to shield bottom 40 of magnet 20. As such, when vehicle flag 10 may be mounted on sheet metal S of outside O of vehicle V, bottom surface 38 may be positioned between sheet metal S and bottom 40 of magnet 20. Bottom surface may be configured to not only prevent magnet 20 from coming off of pole 12, but also may be made of a material that will not scratch or harm the surface that vehicle flag is mounted on, like sheet metal S of vehicle V. For example, bottom surface 38 may be made from a plastic and/or may include a cloth or soft material on its bottom to prevent any scratching or damage to the surface that it is mounted to. Bottom surface 38 may have any desired size and shape. In select embodiments, as shown in the figures, bottom surface 38 may have circular shape 42 with diameter 44. For example, diameter 44 of circular shape 42 of bottom surface 38 may be approximately 2.8 inches.

Cover 46 may be included on pole 12 or as a part of attachment 16. Cover 46 may be for covering magnet 20. Cover 46 may be sized to fit over top 48 of magnet 20 and/or around outside 50 of magnet 20. In select embodiments, cover 46 may include raised portion 52 sized to fit over the top of flanges 34 at proximal end 18 of pole 12. Raised portion 52 may be a raised section by a curve designed to allow room for flanges 34 which may be taller than thickness 32 of magnets 20. In combination, cover 46 and bottom surface 38 may be configured to conceal magnet 20 on proximal end 18 of pole 12. In select embodiments, cover 46 may be connected or sealed to the outer rim or edge of bottom surface 38. In select embodiments, cover 46 may be locked in place on top of magnet 20. In these embodiments, cover 46 may be locked in place on top of magnet 20 by any means. As shown in the figures, in select embodiments, lip 54 may be included on pole 12 for locking cover 46 on top of magnet 20 for sealing cover 46 to bottom surface 38. See FIGS. 3 and 4. Lip 54 may be configured to lock cover 46 in place on magnet 20. In select embodiments, lip 54 may be compressible in the downward direction for sliding cover 46 down pole 12 and over lip 54.

Lock 56 may be included on pole 12. See FIGS. 1 and 3. Lock 56 may be for securing flag 14 on pole 12. Lock 56 may be located near distal end 62 of pole 12. Lock 56 may be configured to lock flag 14 on pole 12. Lock 56 may include any device or means for locking flag 14 on pole 12. In select embodiments, as shown in the figures, lock may include clip 58 and associated indention 60. Indention 60 may be near distal end 62 of pole 12. Indention 60 may be sized and/or configured to receive clip 58. Whereby, once flag 14 may be positioned on pole 12, and clip 58 is inserted into indention 60, clip 58 may be sized to lock flag 14 on pole 12 by preventing or stopping flag 14 from sliding off distal end 62 of pole 12.

Flag 14 may be included in vehicle flag 10. Flag may be for providing a surface or material for indication or signaling. Flag 14 may be for, but is not limited to, signaling for emergency roadside assistance or notifying oncoming traffic of a vehicle on the side of the road. Flag 14 may include reflective material 64 on one or both sides, possibly preferably on both sides. Reflective material 64 may be a highly reflective material configured to make flag 14 visible at night to oncoming traffic in both directions. Flag 14 may include any type of signal or notification to indicate the stranded vehicle or for indication of the need for emergency roadside assistance. For example, flag 14 may include caution symbol 66 on one or both sides, possibly preferably on both sides. Caution symbol 66 may be any caution symbol, including, but not limited to, triangle 68, as shown in the figures. Triangle may be made from reflective material 64 and may have thickness 70 configured to make triangle 68 visible at night to oncoming traffic in both directions. As examples, flag 14 may include base neon color 72 made of vinyl scrim 74, and triangle 68 may be bright white 76 made of reflective calendared vinyl 78.

Flag 14 may be any desired shape or size. In select possibly preferred embodiments, as shown in the figures, flag 14 may be a square or rectangular shape with width 80 and length 82. Width 80 and length 82 may be sized to make flag 14 visible to oncoming traffic. As examples, and clearly not limited thereto, flag 14 may have width 80 of approximately or equal to 12 inches, and/or length 82 of approximately or equal to 13 inches, where triangle 68 is positioned on both sides with width 84 of 10.75 inches and height 86 of 9.5 inches, where triangle 68 may be positioned 0.5 inches from bottom edge 88 of flag 14 and 3 inches from top edge 90 of flag 14.

Flag 14 may be attached to pole 12 by any desired means. In select possibly preferred embodiments, as shown in the figures, flag 14 may include pocket 92 along top edge 90. Pocket 92 may be configured to receive pole 12. As examples, and clearly not limited thereto, pocket 92 may have diameter 94 of approximately 0.5 inches when pole 12 may have a similar diameter of approximately 0.5 inches.

In select embodiments, flag 14 may include flame retardant material 96 for making flag 14 flame retardant or flame resistant.

In another aspect, the instant disclosure embraces magnetic flag pole 11. Magnetic flag pole 11 may be included in vehicle flag 10 for emergency roadside assistance, but is not limited thereto, and may be used or included in other various systems requiring a flag pole that can be mounted by magnets. Magnetic flag pole 11 may generally include pole 12 and attachment 16. Attachment 16 may be at proximal end 18 of pole 12. Attachment 16 may include magnet 20 for connecting the pole to magnetic surfaces, including, but not limited to, sheet metal S on outside O of vehicle V, as shown in FIG. 2. Magnetic flag pole 11 may include any or all of the features from pole 12 and attachment 16 of vehicle flag 10, as shown and/or discussed herein.

Figure 6:
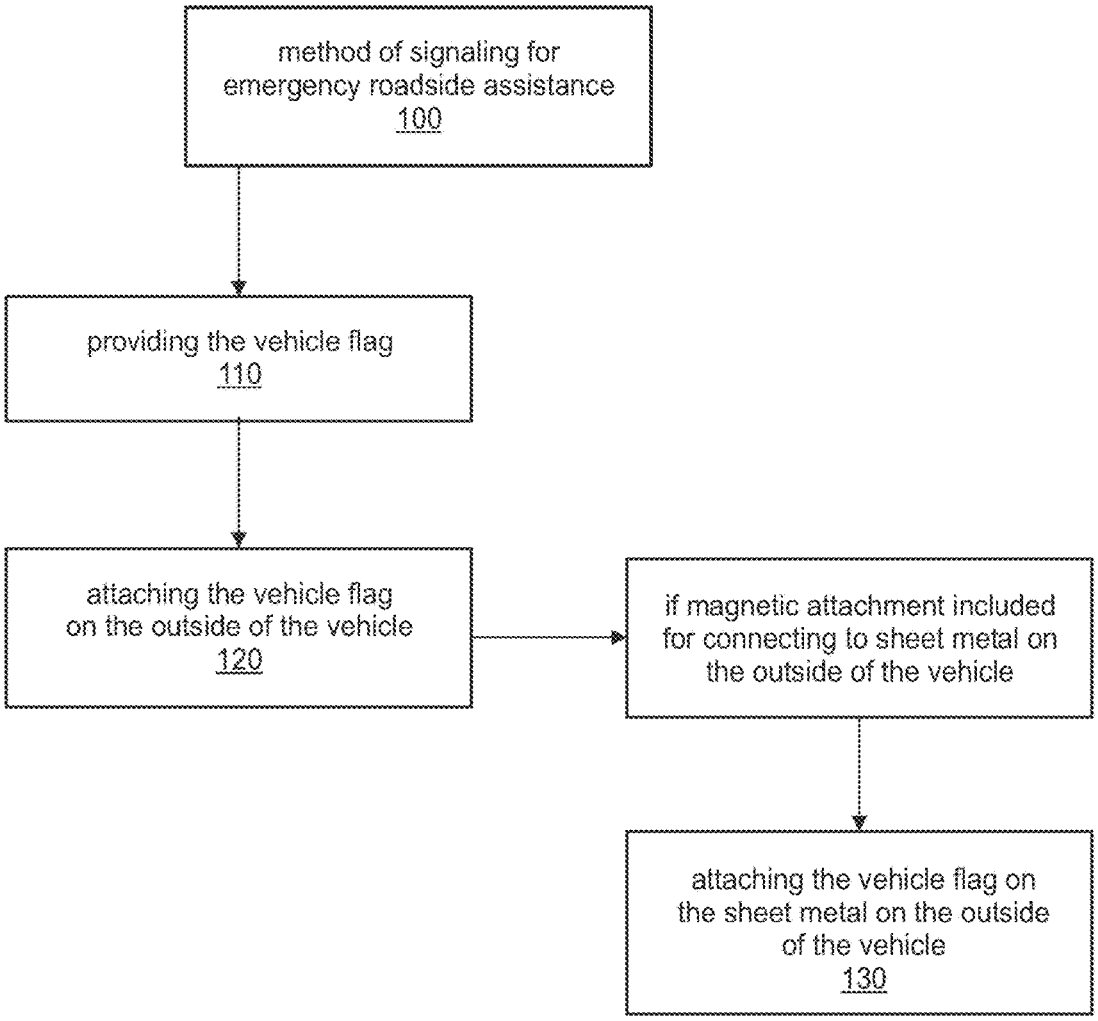
FIG. 6 is a block diagram of the method of signaling for emergency roadside assistance according to select embodiments of the instant disclosure.

Referring now to FIG. 6, in use, method 100 of signaling for emergency roadside assistance may be carried out utilizing any of the various embodiments of vehicle flag 10 shown and/or described herein or magnetic flag pole 11. Method 100 may be for signaling for emergency roadside assistance and/or for indicating to oncoming traffic of a vehicle on the side of the road. Method 100 may generally include the steps of:

Step 110 of providing vehicle flag 10 (or magnetic flag pole 11) in any of the various embodiments shown and/or described herein; and Step 120 of attaching vehicle flag 10 (or magnetic flag pole 11) on outside O of vehicle V.

In select embodiments of method 100 of signaling for emergency roadside assistance, with embodiments of attachment 16 that include magnet 20 (like magnetic flag pole 11), like for connecting to sheet metal S on outside O of vehicle V, step 120 of attaching vehicle flag 10 (or magnetic flag pole 11) on outside O of vehicle V may include step 130 of attaching vehicle flag 10 (or magnetic flag pole 11) on sheet metal S on outside O of vehicle V. As an example, and clearly not limited thereto, step 130 may include attaching vehicle flag 10 (or magnetic flag pole 11) on a convenient location on outside O of vehicle V that does not require the user to exit the vehicle, like on the sheet metal S above the driver's window. This position may not only be convenient for the user, but may also provide a high central location on the vehicle for high visibility to oncoming traffic.

As such, vehicle flag 10, magnetic flag pole 11, and method 100 of signaling for emergency roadside assistance may provide a device, means and method for magnetically attaching a highly reflective flag to the outside of a car or vehicle V, like just above the driver's window on the sheet metal S. This device, means and process may be easy, straightforward, convenient and can be carried out even when the battery is drained or dead, as it does not require one to roll down any windows. As a result, the instant disclosure may be ideally usable as a signal for emergency roadside assistance as it is reflective and does not require the battery to be functional to roll down the window to attach the flag to the car.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein, but is limited only by the following claims.

What is claimed is:

1. A vehicle flag comprising:

a pole;

a flag positioned on the pole; and an attachment at a proximal end of the pole, said attachment is configured to connect to an outside of a vehicle;

wherein the attachment including a magnet for connecting to sheet metal on the outside of the vehicle, the magnet having a pull strength configured to secure the vehicle flag to the sheet metal on the outside of the vehicle in an environment of the vehicle, wherein the magnet is a donut shaped magnet, wherein the donut shaped magnet including:

an inside diameter sized to fit around the at least two flanges at the proximal end of the pole, the at least two flanges are configured to position and center the donut shaped magnet around the pole, the at least two flanges being sized with a combined width approximately equal to the inside diameter of the donut shaped magnet, whereby, the at least two flanges restrict radial movement of the magnet about the pole;

an outside diameter sized to fit within the attachment at the proximal end of the pole; and a thickness sized to fit within the attachment at the proximal end of the pole;

wherein the attachment at the proximal end of the pole including a cover sized to fit over a top of the magnet and around an outside of the magnet;

wherein the cover and a bottom surface combine to conceal the magnet on the proximal end of the pole;

wherein the cover including a raised portion sized to fit over the top of the at least two flanges at the proximal end of the pole;

wherein the pole including a lip configured to lock the cover in place on the magnet, said lip being compressible in a downward direction for sliding the cover down the pole and over the lip.

2. The vehicle flag of claim 1, wherein the magnet is made of a grade 5 ceramic.

3. The vehicle flag of claim 1, wherein the pole including four flanges equally spaced around the proximal end of the pole.

4. The vehicle flag of claim 1, wherein the pole including a lock near a distal end of the pole configured to secure the flag on the pole, the lock including:

a clip; and an indention near the distal end of the pole configured to receive the clip;

whereby, once the flag is positioned on the pole, and the clip is inserted into the indention, the clip secures the flag on the pole.

5. The vehicle flag of claim 1, wherein the flag includes:

a reflective material on both sides configured to make the flag visible at night to oncoming traffic in both directions;

a caution symbol on both sides, the caution symbol is a triangle, said triangle being made from the reflective material and having a thickness configured to make the triangle visible at night to oncoming traffic in both directions;

a base neon color made of a vinyl scrim and the triangle is a bright white made of reflective calendared vinyl;

a width and a length sized to be visible by oncoming traffic;

a pocket along a top edge configured to receive the pole, said pocket having a diameter of approximately 0.5 inches and said pole having a corresponding diameter of approximately 0.5 inches; and/or a flame retardant material.

6. A method of signaling for emergency roadside assistance comprising the steps of:

providing a vehicle flag comprising:

a pole;

a flag positioned on the pole made of a reflective material with a caution symbol on both sides being configured to make the flag visible at night to oncoming traffic in both directions; and an attachment at a proximal end of the pole, said attachment is configured to connect to an outside of a vehicle;

wherein the attachment including a magnet for connecting to sheet metal on the outside of the vehicle, the magnet having a pull strength configured to secure the vehicle flag to the sheet metal on the outside of the vehicle in an environment of the vehicle, wherein the magnet is a donut shaped magnet, wherein the donut shaped magnet including:

an inside diameter sized to fit around the at least two flanges at the proximal end of the pole, the at least two flanges are configured to position and center the donut shaped magnet around the pole, the at least two flanges being sized with a combined width approximately equal to the inside diameter of the donut shaped magnet, whereby, the at least two flanges restrict radial movement of the magnet about the pole;

an outside diameter sized to fit within the attachment at the proximal end of the pole; and a thickness sized to fit within the attachment at the proximal end of the pole;

wherein the attachment at the proximal end of the pole including a cover sized to fit over a top of the magnet and around an outside of the magnet;

wherein the cover and a bottom surface combine to conceal the magnet on the proximal end of the pole;

wherein the cover including a raised portion sized to fit over the top of the at least two flanges at the proximal end of the pole;

wherein the pole including a lip configured to lock the cover in place on the magnet, said lip being compressible in a downward direction for sliding the cover down the pole and over the lip;

attaching the vehicle flag on the sheet metal on the outside of the vehicle.

* * * * *